United States Patent [19]

Cumin

[11] Patent Number: 4,901,451

[45] Date of Patent: Feb. 20, 1990

[54] TIGHTENING DEVICE FOR ATHLETIC SHOE

[75] Inventor: Christophe Cumin, Annecy, France

[73] Assignee: Salomon S. A., Annecy, France

[21] Appl. No.: 179,801

[22] Filed: Apr. 11, 1988

[30] Foreign Application Priority Data

Apr. 10, 1987 [FR] France ..... 87 05560

[51] Int. Cl.[4] ..... A43B 7/18; A43B 7/14

[52] U.S. Cl. ..... 36/50; 128/611

[58] Field of Search ..... 36/50, 89, 90; 128/610, 128/611

[56] References Cited

U.S. PATENT DOCUMENTS

| | | | |
|---|---|---|---|
| 252,715 | 1/1882 | Bass | 36/50 |
| 1,646,920 | 10/1927 | Livignano | 128/611 |
| 1,956,703 | 5/1934 | Vandewater | 128/611 |
| 2,068,251 | 1/1937 | Ullrich | 128/611 |
| 2,188,182 | 1/1940 | Gould | 128/611 |
| 4,441,265 | 4/1984 | Burns et al. | 36/89 |
| 4,547,981 | 10/1985 | Thais et al. | 36/89 |

FOREIGN PATENT DOCUMENTS

| | | | |
|---|---|---|---|
| 412564 | 7/1910 | France | 36/50 |
| 346133 | 6/1960 | Switzerland | 128/611 |
| 28614 | 12/1913 | United Kingdom | 36/50 |
| 11329 | 8/1915 | United Kingdom | 128/611 |

*Primary Examiner*—Steven N. Meyers

*Attorney, Agent, or Firm*—Pollock, Vande Sande & Priddy

[57] ABSTRACT

Athletic shoe comprised of a sole (1) to which is attached a vamp (2), of which the upper anterior portion contains a slit (3) associated with a system (6) for tightening the shoe and covered with a closing flap (7). A yoke (11) fastened to the sole extends inside the vamp to the slit (3) and is secured by its upper border (16) to the system for tightening the shoe (6) in such a way that it is brought into contact with the edge (4) of the above-mentioned slit.

8 Claims, 3 Drawing Sheets

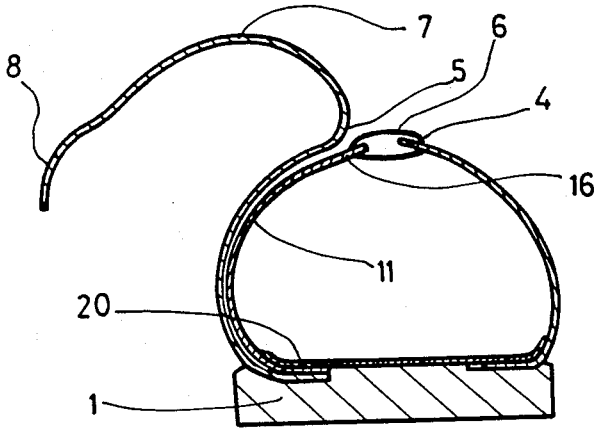
FIG. 2a
FIG.3
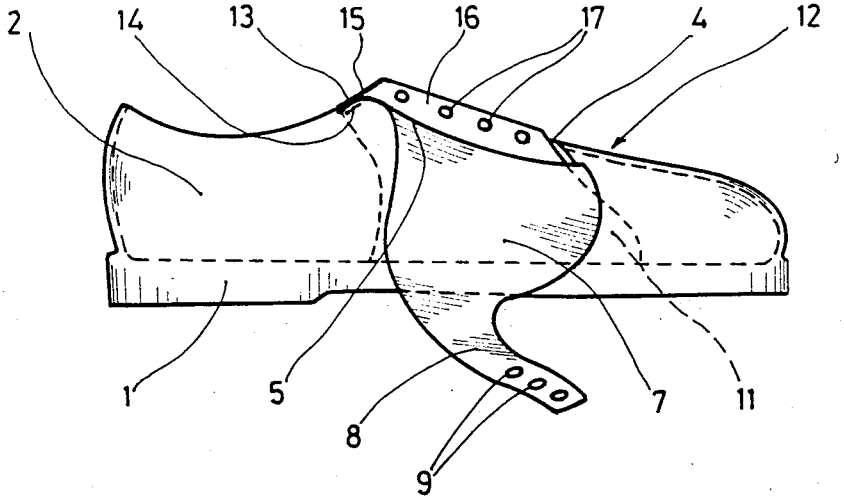

TIGHTENING DEVICE FOR ATHLETIC SHOE

FIELD OF THE INVENTION

The invention concerns shoes, especially shoes for the performance of sports such as golf, and relates in particular to the methods used to ensure the stability of the foot within these shoes for the different morphologies the foot may possess.

BACKGROUND OF THE INVENTION

Traditionally, shoes contain, in the upper portion of the vamp, a slit which extends visibly into the area corresponding to the instep, and a device for securing the shoe to the foot by bringing together the edges of said slit, for example by the use of a lacing arrangement, in order to bring about the superposition of the vamp over the foot. This type of shoe construction is relatively adaptable to different morphologies of the foot, because it facilitates the regulation of the amount of space between the edges of the slit, and, most especially, because it allows the shoe, for any particular size, to fit several sizes of insteps; it is evident that, as the size of the foot decreases, the metatarsus has progressively greater range of free movement within the portion of the vamp enclosing it, which is not affected by bringing together the edges of the slit that work together with the lacing. It also becomes apparent that the shoe vamp bends and/or loses it shape to a progressively greater extent at the point where it joins the closed end of the slit, as the tight fit over the instep and the free movement of the metatarsus in relation to shoe size become more pronounced. The solution to these problems would obviously entail molding each shoe on the shape and size of each foot, a utopian measure given the current industrial and economic context. On the other hand, different well-known solutions have been devised, consisting, for example, in the standardization of shoe sizes on the basis of increments of length, variable by country, of 6.6 mm for French sizes and of 8.46 mm for American sizes. Proposals have also been made for shoes with adjustable sizes and/or shoes equipped with foot-anchoring devices which are adjustable on the basis of foot size and which are contained within the vamp. The shoes described in U.S. Pat. Nos. 2,112,052 and 1,633,413 may be cited as examples, these patents concerning, respectively, a shoe which is adjustable in length according to the relative movement of the heel in relation to the extremity of the shoe, and a shoe whose internal support structure can be shifted longitudinally in relation to the vamp as a function of foot length. Shoes of this kind have proved to involve the use of complicated methods for allowing the adjustment of length, and have shown themselves to be poorly adapted for uses such as running or walking.

Other types of shoes, such as those described in the French Pat. Nos. 2,541,093 and 2,534,459, have devices for anchoring the foot that are adjustable and are contained within the vamp, which, in itself, performs the sole function of covering the foot. In these shoes, the yokes, designed to ensure the stability of the foot, extend symmetrically in relation to the foot into the area corresponding substantially to the position of the extremities of the first and fifth metatarsals. Thus, by bringing together the free ends of these yokes, the anchoring of the foot onto the sole and, in particular, its longitudinal stability exercised in the area of the metatarsus are ensured. German Pat. No. 399,491 may also be mentioned as an example, since it describes a shoe equipped, first, with an interior securing arrangement designed to adjust an interior supporting tongue for the plantar arch of the foot, and, second, with a device for tightening the vamp over the foot. The combination of such methods for holding the foot firmly in place also does not permit optimal tightening of the metatarsus for the smallest foot sizes included in the range of size increments for a shoe under consideration.

SUMMARY OF THE INVENTION

The invention attempts to solve these various problems by creating a shoe designed to fit a range of foot sizes for a given shoe size, and by incorporating the means for keeping the foot in place to ensure, at the same time, the close fit of the vamp over the foot and the stabilizing of the metatarsus, without requiring a sizeable opening in the upper laced part of the vamp extending, most notably, into the area of the metatarsus, and all of this without causing changes in the external appearance of said vamp even in the case of the smallest foot widths for a particular shoe size. Furthermore, because the invention incorporates the possibility for adjusting the means for securing the shoe over the foot, another purpose of the invention is a reduced range of shoe sizes, having increments of length relatively greater than the standardized lengths, in order to fit all foot dimensions.

The shoe according to the invention incorporates, in a manner known per se, a sole to which is fastened a vamp having, on its upper portion, a transverse flap covering a V-shaped slit whose widened portion opens out toward the upper end of the shoe shaft. This flap, arranged transversally to the median longitudinal axis of the slit, extends from the internal surface of the shoe above said slit, and is extended by a lateral tongue designed to contribute to holding the shoe in a tightly-secured position on the foot using a fastening arrangement such as a buckle, a button, a hook or the like, attached to the other side of the shoe vamp, which corresponds in position to the other edge of the slit. In accordance with the invention, only one of the edges of the slit is associated with means for tightening the shoe which secure, by brining it together with said edge, the upper border of the free extremity of a yoke which, attached to the sole, extends freely, at least on part, on the inside of the vamp on the side opposite to the aforementioned edge of the slit. The yoke has a free range of movement from at least substantially the area corresponding to the upper extremity of the first metatarsal of the foot to the anterior upper edge of the vamp to which it is attached by any conventional method such as a sewn seam, gluing, etc., in a position opposite to the border of the slit associated with the tightening system of the shoe. A construction of this type creates a gripping action spread out over a large part of the upper area of the foot, and takes up free motion in the area of the metatarsus beginning at least with the first metatarsal, even in the case of a small foot. Furthermore, since this compensation for free movement takes place on the inside of the vamp by means of the abovementioned yoke, no external deformation or crinkling of the vamp occurs. Thus, for any given stock size, the shoe can accommodate many different feet of a smaller size by guaranteeing optimal gripping action of the shoe over the foot and the metatarsus, simultaneously, in the region of the metatarsal-phalangeal joints, without producing any apparent change in the external appearance of the vamp. In this way, it is possible to provide only a relatively small number of stock shoe sizes for a large range of foot sizes.

The means for tightening the shoe which facilitate the joining of the free edge of the yoke to the edge of the slit in the vamp may be equally well made up of a system of laces, buckles, thongs, etc.

According to one embodiment of the shoe which is the object of the invention, the overlapping transverse tongue covers the entire upper anterior portion of the vamp and completely conceals the slit in the vamp, as well as the associated system for tightening the shoe.

Furthermore, the transverse tongue may advantageously be patterned to fit perfectly on the vamp and/or to comprise a junction-piece, in order to ensure the leak-tightness of the upper anterior portion of the shoe.

BRIEF DESCRIPTION OF THE DRAWINGS

The invention will be better understood by referring to the following description based on the attached schematic drawings which show, by way of example, one embodiment of the shoe according to the invention.

FIG. 2*a* is a section view along line II—II of FIG. 2.

FIG. 3 is a side view of the shoe indicating the attachment of the internal yoke to the vamp.

DESCRIPTION OF THE PREFERRED EMBODIMENT

Figure 1:
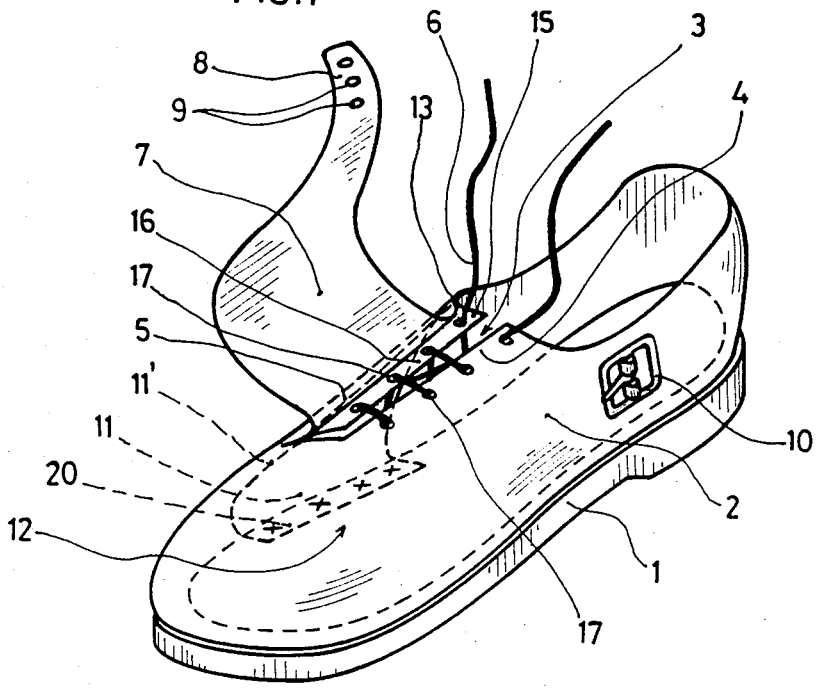
FIG. 1 is a schematic perspective view showing a shoe equipped with a device for anchoring the foot in accordance with the invention.
Figure 2:
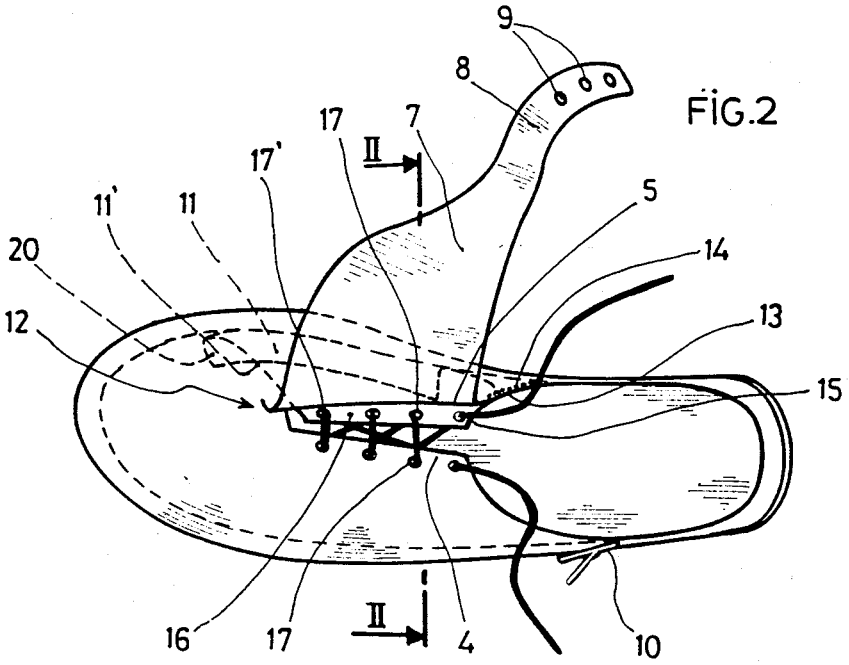
FIG. 2 is a plan view of the shoe in FIG. 1, showing a detail of the device for tightening the shoe on the foot, and, in particular, the position of the internal yoke holding the foot in place in the shoe.

The shoe shown in FIGS. 1, 2, and 3, of the so-called "low shaft" type, comprises, in a manner known per se, a sole (1) on which is fastened a vamp (2), whose upper anterior part contains a slit (3) one (4) of whose longitudinal edges (4 and 16) is associated with a lacing system (6), while a second external edge (5), superposed on the edge just mentioned (16), is provided with a covering flap (7), attached transversally to the longitudinal axis of the slit (3). The extremity or tongue (8) of said flap (7) is provided in this embodiment of the invention with holes (9) for cooperation with a buckle (10) having a tang, which buckle is attached to the vamp (2) over the side on which the flap is folded. In the shoe according to the invention, the covering flap (7) is made up of an added extension or of a single piece attached to one of the sides of the vamp (2). When said flap is folded back in the "open" position of the shoe, the area of the fold delimits the above-mentioned second external edge (5) of the slit (3). According to the invention, a yoke (11), joined to the sole (1), extends along the interior of the vamp (2) substantially from the area (20) corresponding to the position of the upper end of the first metatarsal, to the anterior upper portion (13) of the shaft, in a position facing the edge (4) of the slit (3). This yoke (11) is attached, by its upper extremity (15), near the upper anterior edge (13) of the vamp (2), for example by a seam, in order to facilitate the retightening of the vamp around the ankle when the shoe is tied, while its edge (16), delimiting its free end, extends to the slit (3) and connects with the longitudinal edge (4) of the slit. The lacing arrangement (6) cooperates with multiple holes (17) pierced respectively on the border (16) and the edge (4) of the slit (3) of the vamp in such a way as to move the yoke (11) toward the above-mentioned opposite edge (4). Thus, by exercising traction on the lacing system (6), the border (16) of the free end of the yoke (11) tends to position itself against the edge (4) of the vamp, and pulls proportionately on said yoke, of which the portion (11'), contained between the area of attachment (20) and the most anterior of the holes (17') of the lacing system, flattens out against the front part of the foot (12). Thus, the joining of the laced parts of the shoe (16 and 4), which exerts pressure on the foot, especially in the area of the instep, ensures the solid anchoring of the foot. The closing of the upper part of the vamp around the ankle is the result of covering the lacing system with the flap (7) which attaches to the vamp by means of its tongue (8) inserted into a buckling system (10).

As explained previously, the function of the flap (7) is to cover the slit (3) and the lacing system (6), at least partially. The flap (7) may advantageously be provided with a joint or may be patterned in such a way as to fit into the vamp and thus ensure the tightness of the upper anterior part of the shoe.

Figure 4:
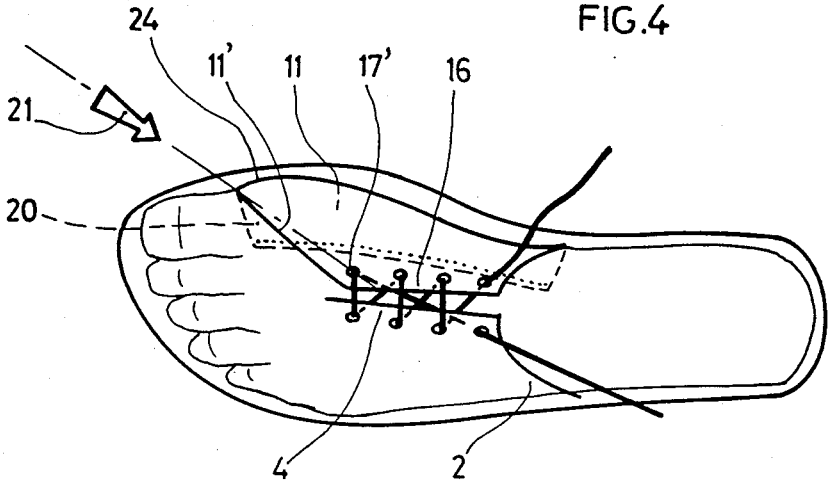
FIGS. 4 and 5 illustrate schematically the operation of the device for securing the foot as it adapts to different foot sizes.

FIG. 4 shows schematically the fitting of the shoe over a foot having the largest possible dimensions for a given stock size of the shoe in question. As may be seen in more detail from this drawing, the fitting together of the edge (4) of the vamp (2) and of the edge (16) of the yoke (11) produces the effect of pulling on the part (11') of the yoke in a front-to-back direction (21) which corresponds substantially to the direction of a line passing through the area of attachment (20) of said yoke (11) to the sole (1) and the front-most hole (17') of the lacing system on the edge (16).

Figure 5:
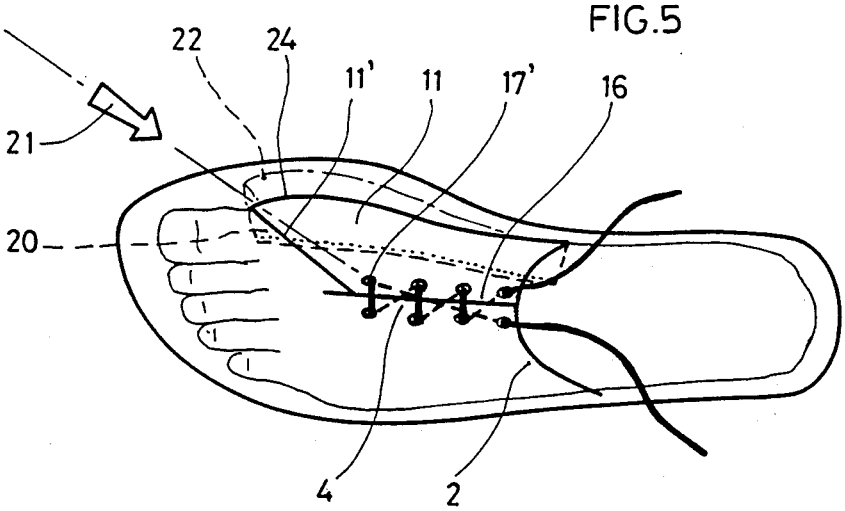

When tightening the shoe on a narrow foot (FIG. 5), the joining of the edge (4) with the edge (16) is particularly important because the metatarsal-phalangeal region is small. Tightening is achieved using the yoke (11), as explained above, and the foot remains wedged against the outside wall of the shoe. The space differential in the area of the metatarsal-phalangeal joint is then compensated for by a corresponding shift in the anterior portion (11') of said yoke (11) over the extremity (24) of the first metatarsal of the foot.

It will be understood that a tightening system of this kind may be equally well adapted to "high shaft" and "low shaft" shoes.

What is claimed is:

1. Athletic shoe comprising a sole to which is attached a vamp constituting the shaft of the shoe, containing in its upper anterior portion a slit opening toward the upper part of said shaft, the slit being associated with means for tightening the shoe and being covered by a closing flap, wherein (a) one (4) of the edges of the slit (3) is comprised of a free end of a first side of the vamp (2), the other (16) edge of said slit (3) being comprised of a free end of a yoke (11) attached to the sole (1) on a second side of the vamp (2) and to the inside of the vamp;

(b) the closing flap (7) is comprised of the extension of the said second side of the vamp (2) extending transversely to the longitudinal axis of the shoe in order to cooperate with the means for tightening the shoe located on the first side of the vamp; and (c) said internal yoke (11) is partially joined to the second side of the vamp (2) at a point (14) located on an upper border 13 of said vamp.

2. Shoe according to claim 1, wherein the yoke (11) extends freely into the vamp (2) in the direction of the heel, substantially from an area (20) corresponding to the position of the head of a first metatarsal of the foot, said first metatarsal being entirely covered from an anterior portion (11') of said yoke to the upper anterior portion of the vamp (2), to which it is attached.

3. Shoe according to claim 1 or 2, wherein the slit (3) extends through the upper anterior portion of the vamp (2) from at least an area corresponding to the metatarsus (12) located substantially at the level of the first metatarsal of the foot to the area of closing around the ankle.

4. Shoe according to claim 1 or 2, wherein the means for tightening the shoe are comprised of a lacing system (6) incorporated into the edges (4) and (16), said edges each being provided with a plurality of holes.

5. Shoe according to claim 4, wherein the edge (16) of the yoke (11) contains a hole (17') in its extreme anterior portion, corresponding substantially to the closed end of the slit (3), the position of which in relation of the area of attachment (20) of said yoke to the sole (1) substantially determines the direction (21) of the tightening of a portion (11') of the yoke (11) at the level of the perimeter of the metatarsal-phalangeal articulation.

6. Shoe according to claim 1 or 2, wherein the area of folding of the closing flap (7), which is an extension of the second side of the vamp (2), delimits a second external edge (5) of the slit in the "open" position of the shoe.

7. Shoe according to claim 1 or 2, wherein the flap (7) contains means for adjustment and tightening with the vamp (2) in the area covered.

8. Shoe according to claim 1 or 2, wherein the closing flap (7) is attached to the vamp (2) by conventional attachment means.

* * * * *